US005931319A

United States Patent [19]

Murphy

[11] Patent Number: 5,931,319

[45] Date of Patent: Aug. 3, 1999

[54] JEWELRY STORAGE APPARATUS

[76] Inventor: Mary Jane Murphy, 64 Dunbar Rd., Windsor, N.Y. 13865

[21] Appl. No.: 08/892,666

[22] Filed: Jul. 14, 1997

[51] Int. Cl.[6] ..... A47F 7/02

[52] U.S. Cl. ..... 211/85.2

[58] Field of Search ..... 211/85.2; 206/566; 312/245

[56] References Cited

U.S. PATENT DOCUMENTS

| | | | |
|---|---|---|---|
| D. 257,807 | 1/1981 | Vander Velde et al. | D6/114 |
| D. 319,749 | 9/1991 | McPherson | D6/571 |
| D. 333,929 | 3/1993 | Sandor | D6/457 |
| D. 338,575 | 8/1993 | Takaya et al. | D6/467 |
| 3,421,634 | 1/1969 | Huth | 211/123 |
| 4,093,077 | 6/1978 | Strasser | 211/194 |
| 4,767,011 | 8/1988 | Butler | 211/85.2 |
| 5,035,319 | 7/1991 | Snyder | 206/566 |
| 5,050,745 | 9/1991 | Sanders | 211/85.2 |
| 5,052,563 | 10/1991 | Camp | 211/85.2 |
| 5,087,105 | 2/1992 | White | 211/85.2 |

*Primary Examiner*—Alvin Chin-Shue
*Assistant Examiner*—Sarah Purol
*Attorney, Agent, or Firm*—David L. Volk

[57] ABSTRACT

A container includes a hinged door. The door comprises a frame holding a screen therein. The screen is adapted for placement of at least one earring having a post thereon, by inserting the post through the screen from a first side of the screen, then placing a post cap over the post on a second side of the screen. The container includes a wall having pegs protruding therefrom. The wall is positioned opposite the door and the pegs extend toward the door when the door is closed.

5 Claims, 3 Drawing Sheets

JEWELRY STORAGE APPARATUS

BACKGROUND OF THE INVENTION

1. Field of the Invention

The present invention relates to storage apparatus, particularly to storage apparatus adapted to store jewelry.

2. Description of the Related Art

Young and mature women alike enjoy owning and wearing jewelry of different types. Proper storage of jewelry is important to prevent loss and damage, and to maintain organization. An appropriate storage device should be easily accessible, so that jewelry can be easily removed and replaced thereon. Such a storage device should also store the jewelry such that all pieces are in view, so that the desired piece can be easily found and removed from the storage device.

SUMMARY OF THE INVENTION

The jewelry storage apparatus of the present invention includes a container having a hinged door. The door comprises a frame holding a screen therein. The screen is adapted for placement of at least one earring having a post thereon, by inserting the post through the screen from a first side of the screen, then placing a post cap over the post on a second side of the screen. The container includes a wall having pegs protruding therefrom. The pegs are adapted for bracelets and necklaces to hang thereon. The wall is positioned opposite the door and the pegs extend toward the door when the door is closed. When the door is closed, bracelets and necklaces hanging from the pegs are enclosed within the container.

The screen and pegs of the apparatus provide a convenient storage means for earrings, necklaces and bracelets. The screen and pegs keep the jewelry organized, with all of the earnings or all of the bracelets and necklaces in view. When the door is closed, all of the jewelry is secure and protected.

Still further features and advantages will become apparent from the ensuing description and drawings.

DETAILED DESCRIPTION

Figure 1:
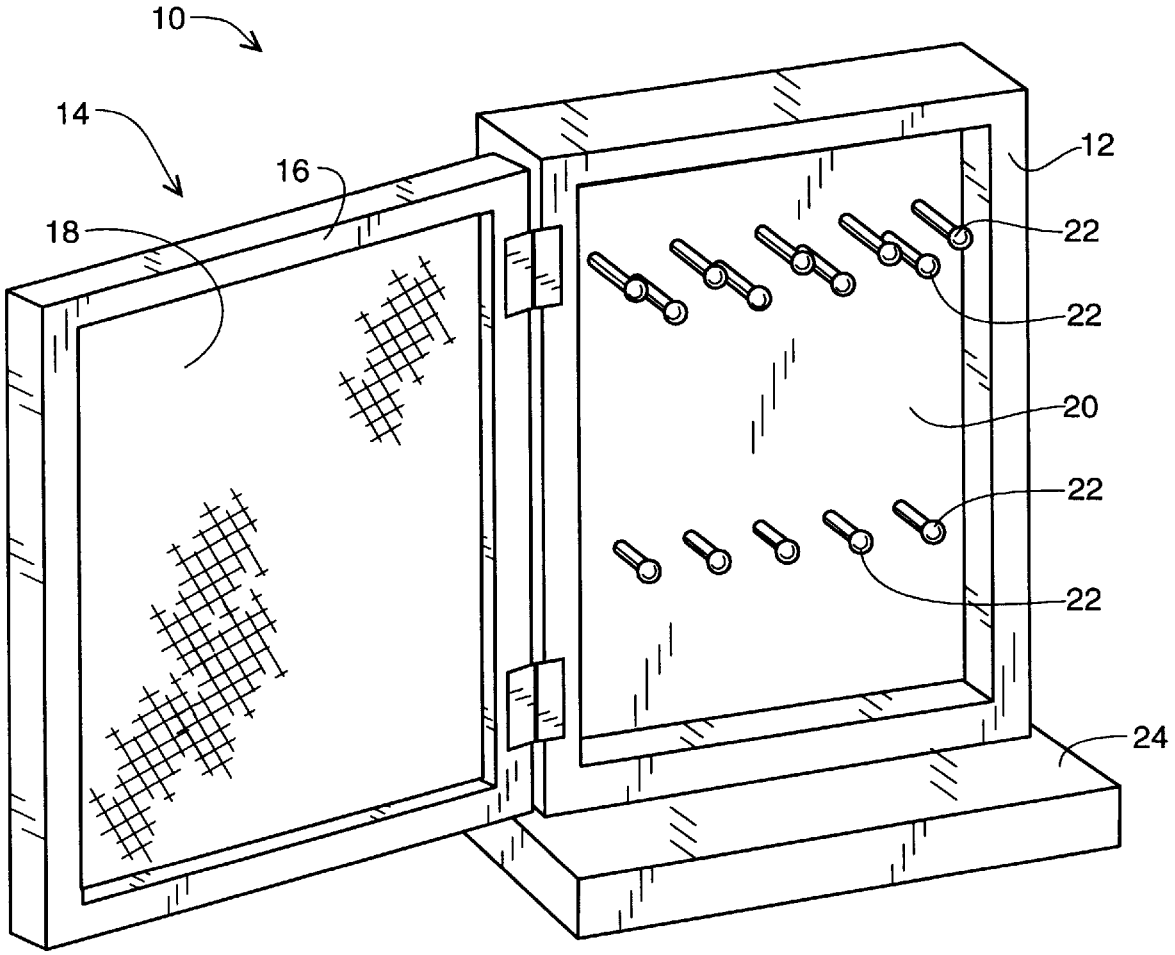
FIG. 1 is a perspective view of the jewelry storage apparatus of the present invention.

FIG. 1 is a perspective view of a jewelry storage apparatus 10 of the present invention. The jewelry storage apparatus 10 includes a container 12 having a hinged door 14. The door 14 comprises a frame 16 holding a screen 18 therein. The container 12 includes a wall 20 having pegs 22 protruding therefrom. The pegs 22 are adapted for bracelets and necklaces (not shown) to hang thereon. The container 12 is configured to rest on a base 24 with the wall 20 in a substantially vertical position.

Figure 2:
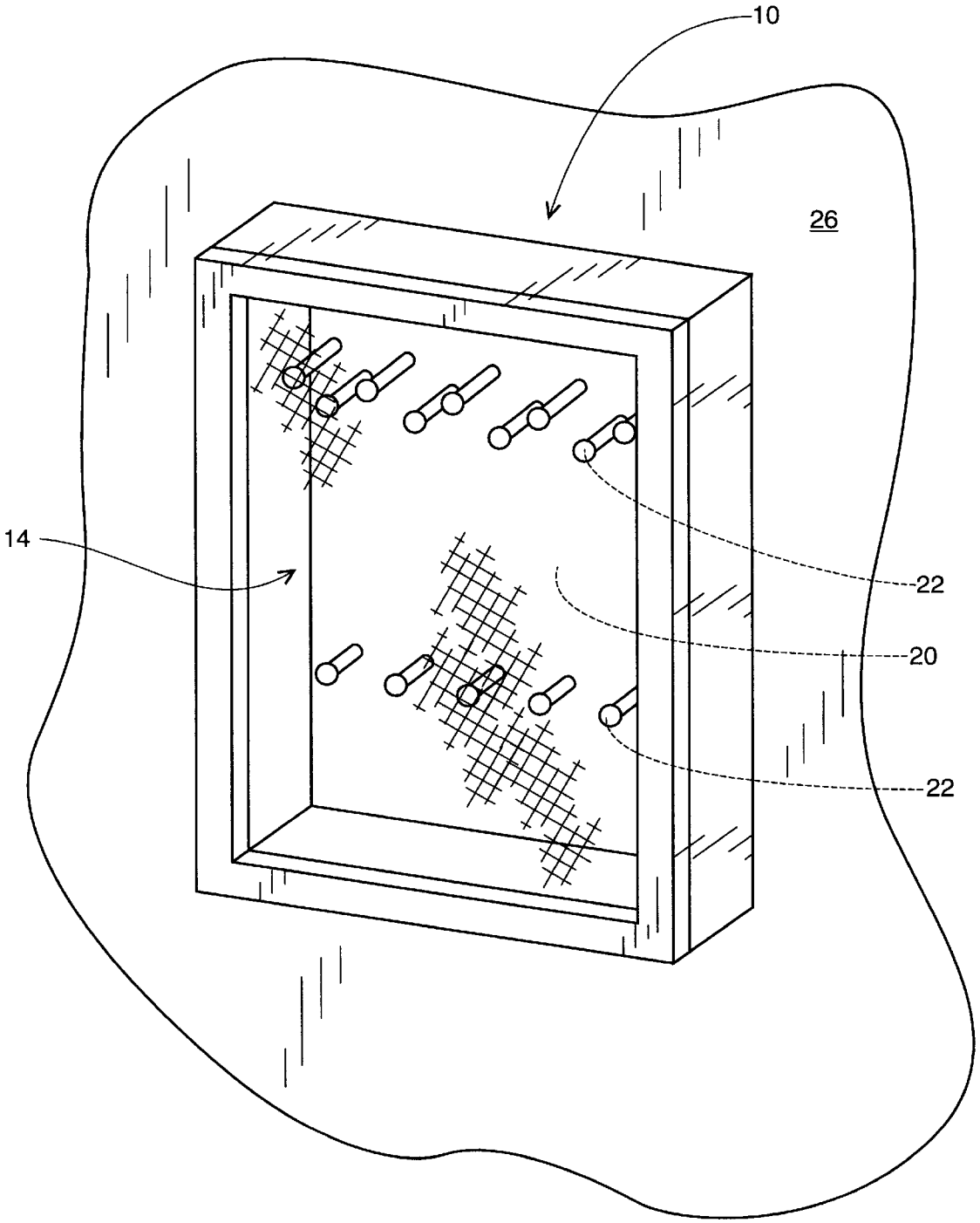
FIG. 2 is a perspective view of the jewelry storage apparatus with the door closed. This view also shows an embodiment of the apparatus adapted for hanging from a vertical surface.

FIG. 2 is a perspective view of the jewelry storage apparatus 10 with the door 14 closed. This view also shows an embodiment of the apparatus 10 which is adapted for hanging from a vertical surface 26, using any conventional hanging means on the back, planar surface (not shown). In this embodiment, the base 24 is deleted. In each of the embodiments disclosed, the wall 20 is positioned opposite the door 14 and the pegs 22 extend toward the door 14 when the door 14 is closed. When the door 14 is closed, bracelets and necklaces (not shown) hanging: from the pegs 22 are enclosed within the container 12.

Figure 3:
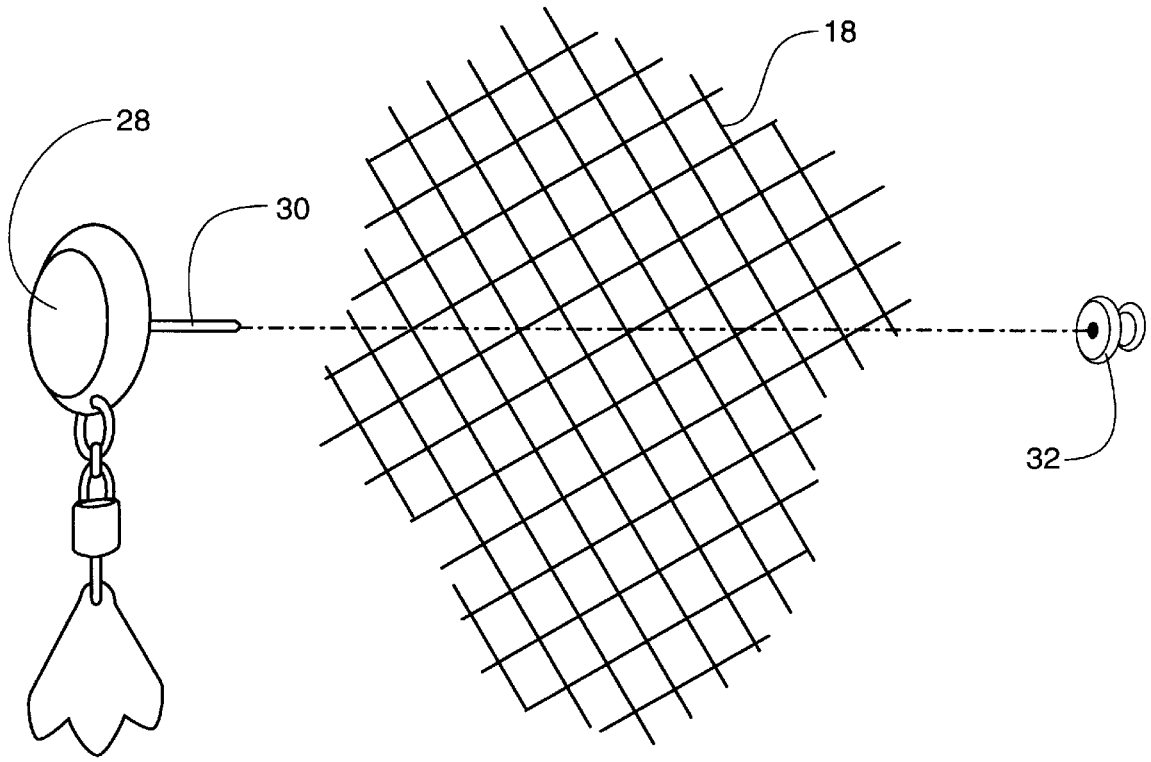
FIG. 3 is an enlarged partial view of the screen of the apparatus, showing the method of storing an earring thereon.

FIG. 3 is an enlarged partial view of the screen 18 of the apparatus 10, showing the method of storing an earring 28 having a post 30 thereon. This is accomplished by inserting the post 30 through the screen 18 from a first side of the screen 18, then placing a post cap 32 over the post 30 on a second side of the screen 18.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A jewelry storage apparatus comprising:

a. a container having a hinged door;

b. the door including a screen adapted for placement of at least one earring having a post thereon, by inserting the post through the screen from a first side of the screen, then placing a post cap over the post on a second side of the screen; and c. the container adapted to store bracelets therein.

2. The apparatus of claim 1, wherein the container rests on a base which is adapted to rest on a horizontal surface.

3. The apparatus of claim 1, wherein the container is adapted to hang on a vertical surface.

4. The apparatus of claim 1, wherein the container includes a wall having pegs protruding therefrom, the pegs adapted for hanging bracelets thereon.

5. A jewelry storage apparatus comprising:

a. a container having a hinged door;

b. the door comprising a frame holding a screen therein;

c. the screen adapted for placement of at least one earring having a post thereon, by inserting the post through the screen from a first side of the screen, then placing a post cap over the post on a second side of the screen;

d. the container including a wall having pegs protruding therefrom, the pegs adapted for hanging bracelets thereon; and e. the wall positioned opposite the door and the pegs extending toward the door when the door is closed, wherein when the door is closed, bracelets hanging from the pegs are enclosed within the container.

* * * * *